US005670946A

United States Patent [19]

Ellwood et al.

[11] Patent Number: 5,670,946

[45] Date of Patent: Sep. 23, 1997

[54] SMOKE DETECTOR SENSITIVITY TESTING APPARATUS

[75] Inventors: Stephen Ellwood, Mountsorrel; David Appleby, Beauchamp, both of United Kingdom

[73] Assignee: No Cilmb Products Limited, Barnet, England

[21] Appl. No.: 549,693

[22] Filed: Feb. 23, 1996

[30] Foreign Application Priority Data

May 4, 1993 [GB] United Kingdom ..... 9309115

[51] Int. Cl.[6] ..... G08B 17/10

[52] U.S. Cl. ..... 340/628; 340/630; 340/515; 73/1 R; 222/402.13; 252/305

[58] Field of Search ..... 340/628, 629, 340/630, 515, 514; 73/1 R, 1 G; 222/402.13, 305

[56] References Cited

U.S. PATENT DOCUMENTS

| | | | |
|---|---|---|---|
| 3,693,401 | 9/1972 | Purt et al. | 340/515 |
| 4,093,867 | 6/1978 | Shah et al. | 250/576 |
| 4,271,693 | 6/1981 | Bute | 73/1 G |
| 4,301,674 | 11/1981 | Haines et al. | 73/1 G |
| 4,462,244 | 7/1984 | Lee | 73/1 |
| 4,827,244 | 5/1989 | Bellavia et al. | 340/628 |
| 5,170,148 | 12/1992 | Duggan et al. | 340/515 |
| 5,309,148 | 5/1994 | Birk | 340/628 |

FOREIGN PATENT DOCUMENTS 1527003 10/1978 United Kingdom .

*Primary Examiner*—Jeffery Hofsass
*Assistant Examiner*—John Tweel, Jr.
*Attorney, Agent, or Firm*—Rankin, Hill, Lewis & Clark

[57] ABSTRACT

Apparatus for testing the sensitivity of a smoke detector (12) in-situ, including a head assembly (1) comprising a housing (14) for surrounding a smoke detector in-situ and forming part of a sensing loop (14, 15, 16, 17)through which air carrying an aerosol will circulate, a sensor (25, 26, 27) for sensing the concentration of aerosol in the air circulating in the loop, a fan (20) for causing air to circulate in the loop, an aerosol container (24) for supplying aerosol to the loop and a control unit 2 for controlling the concentration of aerosol in the air circulating in the loop by controlling the fan (20) and the aerosol container (24) in response to the output of the sensor.

14 Claims, 4 Drawing Sheets

SMOKE DETECTOR SENSITIVITY TESTING APPARATUS

The present invention relates to apparatus for indicating the sensitivity of smoke detectors in-situ, e.g. mounted on a ceiling and connected to an installed fire detection system.

Fire detection and alarm systems are installed in buildings as part of the safety precautions, to help protect both lives and property. To ensure the reliability of the installed system, regular testing and maintenance is required. The majority of fire detectors installed in systems are of the point type i.e. discrete units. These are usually located on the ceiling of a protected space, and work by sampling smoke carried to them in the plume of hot gases resulting from a fire within the protected space. Two types of point smoke detectors are in widespread use. They are optical smoke detectors, the majority of which work by monitoring the scattering of light from smoke particles, and ionisation smoke detectors which work by monitoring the conductance of air ionised by a radioactive source, which changes in the presence of smoke particles.

With both optical and ionisation smoke detectors, it is well known that contamination and ageing of components can significantly affect the sensitivity, and with most existing designs these effects are not fully monitored by the detector. Detectors which drift to a more sensitive state are more prone to give a false alarm, and within certain limits quite small changes in sensitivity can significantly affect the false alarm rate. Detectors which drift to a less sensitive state may delay an alarm signal and reduce the time available for fire fighting and escape. Many detectors contain no internal monitoring of the correct sensor functioning at all, and could be rendered inoperative for long periods by a fault that is not revealed until some form of test is carried out.

The relevant standard for point smoke detectors connected in fire detection systems in the EC is EN54:part7 (equivalent to BS5445:part7 in the UK). This contains requirements which include the ability to pass a series of standard fire tests, which define an acceptable range of sensitivities for newly manufactured smoke detectors. Various standards and codes of practice require that the sensitivity is maintained in installed systems. In the UK, BS5839:part1:1988 recommends that, as part of the defined annual inspection and test schedule, a sensitivity check should be carried out on each detector every year. If the detector is removed from the installed system for sensitivity testing, the check should also ensure that the detector is still functional after being remounted.

In spite of the above recommendations, in-situ sensitivity testing has not been common practice, as suitable test equipment has not been widely available. Where testing is carried out, the normal procedure involves a combination of functional testing and the regular return of detectors to the factory for cleaning and re-calibration, even where this operation is not necessary. In-situ testing of the detector sensitivity would reduce the cost of these procedures and, in general, improve the reliability of systems.

One method by which the sensitivity of a smoke detector may be measured is the so-called smoke tunnel. Smoke tunnels are, however, large and heavy apparatus. To measure the sensitivity Of a smoke detector using a smoke tunnel, the detector is removed from the installed system, installed within the smoke tunnel, and then connected to electronic circuitry which simulates the behaviour of a fire detection system. An example of a standard smoke tunnel is described in EN54:part7 and similar smoke tunnels are used worldwide in test laboratories and by manufacturers of smoke detectors. U.S. Pat. No. 4,093,867 describes one manifestation of such a smoke tunnel.

Apparatus for the in-situ sensitivity testing of smoke detectors have previously been described. The principle of operation of these testers has mainly involved the use of an aerosol generator which generates a known concentration of aerosol, having very well characterised particle sizes and other physical properties. Examples of various methods for achieving this are described in GB patent 1527003, U.S. Pat. No. 4,462,244, and Japanese patent 84025273. However, hitherto such techniques have failed to result in a practical tester for widespread application, either because the apparatus was too cumbersome and difficult to use, or did not prove to be sufficiently accurate in practice.

U.S. Pat. No. 4,462,244 discloses an apparatus for testing the sensitivity of a smoke detector in-situ, comprising a head assembly having a housing for surrounding a smoke detector in-situ and forming part of means defining a path through which air carrying an aerosol will flow, means for causing the air to flow along said path and aerosol supply means. However, there is no disclosure in U.S. Pat. No. 4,462,244 of a sensing means for establishing the concentration of aerosol delivered to the detector nor of any means for controlling the level of concentration of aerosol in the air flow.

According to one aspect of the present invention there is provided apparatus for testing the sensitivity of a smoke detector in-situ, comprising a head assembly comprising a housing for surrounding a smoke detector in-situ and forming part of means defining a circulating loop through which air carrying an aerosol will, in operation, circulate, sensor means for sensing the concentration of aerosol in the air circulating in the loop, air circulating means for causing air to circulate in the loop, aerosol supply means for supplying aerosol to the loop and control means for controlling the concentration of aerosol in the air circulating in the loop by controlling the air circulating means and the aerosol supply means in dependence on the output of the sensing means.

The housing may be generally cup shaped with an opening in the top for surrounding the smoke detector. The opening in the top of the housing may be provided with a seal for sealing around the smoke detector, such that said housing sealingly encloses said detector.

The means defining the loop for circulating air may comprise a chamber communicating with the housing by a first duct for flow of air to the housing and a second duct for flow of air from the housing. The sensor means may be arranged to sense the concentration of aerosol in the first duct. The air circulating means may be arranged in the second duct and may be in the form of a fan which is operated to create a super-atmospheric pressure in the chamber. An air bleed inlet may be provided in the second duct upstream of the air circulating means.

The aerosol supply means may comprise an aerosol reservoir in communication with the chamber, means for generating aerosol in the reservoir and means for controlling the flow of aerosol from the reservoir to the chamber.

The means for controlling the flow of aerosol from the reservoir to the chamber may comprise means for varying the pressure in the reservoir relative to the pressure in the chamber under the control of the control means.

In a particularly preferred embodiment of the invention, a third duct passes through the reservoir from the pressure varying means to the chamber, the third duct having a number of apertures through the walls of the third duct, the apertures connecting the aerosol in the reservoir with the interior of the third duct and hence with the chamber.

The aerosol generating means may comprise a container of liquid having a valved outlet with atomising means and valve operating means controlled by the control means for intermittently generating aerosol in the aerosol reservoir. The aerosol supply means may thus provide a supply of aerosol which is continuously available for supply to the path in the head assembly, although the aerosol is generated discontinuously or intermittently.

Other aerosol generating means may be provided which generate aerosol continuously, the aerosol reservoir providing a mixing or dispersing chamber from which aerosol at a lower concentration is available for supply to the path in the head assembly.

The above described apparatus may be operated by the control means to establish a first lower concentration of aerosol in the air circulating in the housing and to then increase the concentration to a second higher level, the first level being below that at which the smoke detector should be activated and the second being above that at which it should be activated. The apparatus may be used to determine the concentration of aerosol at which a smoke detector is activated or to check that the sensitivity of the smoke detector is between predetermined limits.

Further features and advantages of the present invention will become apparent from the following description of an embodiment thereof, given by way of example only, with reference to the accompanying drawings, in which.

Figure 1:
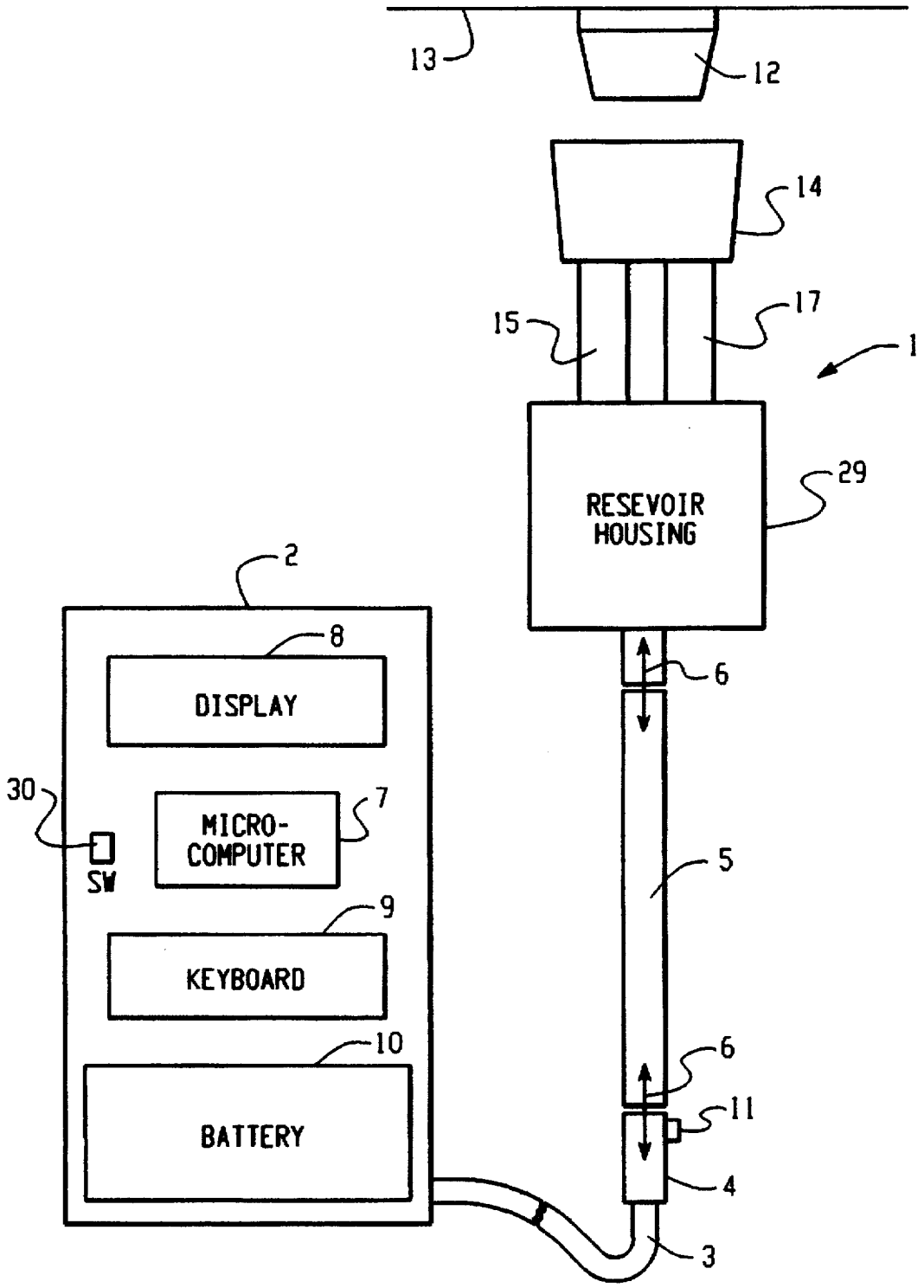
FIG. 1 is a schematic view of an embodiment of apparatus according to the present invention.
Figure 2:
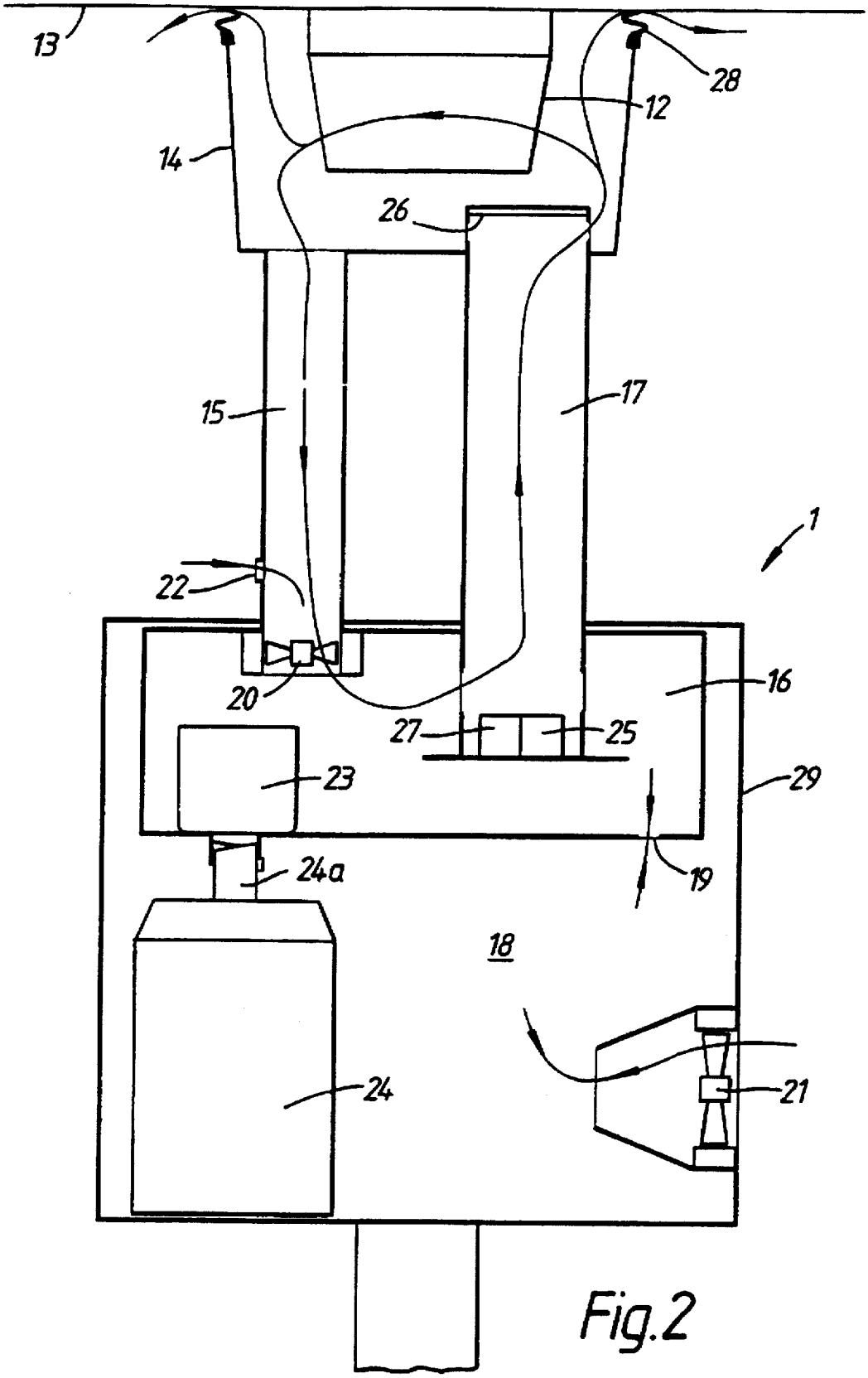
FIG. 2 is a diagrammatic sectional view of part of the apparatus of FIG. 1.

The apparatus shown in FIGS. 1 and 2 includes a lightweight head assembly 1 which is electrically connected to a control unit 2.

As shown in FIG. 2, the head assembly 1 comprises an open-topped housing 14 to be located over and around a smoke detector 12 to be tested in-situ, e.g. mounted on or in a ceiling 13, and which may be connected in a fire detection system. The housing 14 may be of any suitable shape and may, for example, be in the form of a cup which may be made of a transparent material, so that any indicating lamp on the smoke detector is visible during the test, and is provided with a flexible seal 28 around its open top for sealing against the ceiling.

The housing 14 forms part of means defining a path through which air carrying an aerosol will circulate to and from the housing. These means include a chamber 16 and ducts 15 and 17 which communicate at their upper ends with the interior of the cup through its base, and at their lower ends with the chamber 16. The cup 14, ducts 15, 17 and chamber 16 form a sensing loop.

Means are provided for causing air to circulate through the sensing loop and, as shown, comprise an axial fan 20 located in the duct 15 adjacent its connection with chamber 16 and arranged to increase the pressure in the chamber 16 above atmospheric pressure so that the circulating air flows from chamber 16 along duct 17 into the housing 14 and from the housing 14 back to the chamber 16 via the duct 15. The fan 20 may be a constant speed fan and is connected to be controlled by the control unit 2. Air can enter the sensing loop through a bleed inlet 22 in duct 15 upstream of the fan 20.

A sensor is provided for sensing the concentration of aerosol in the air flowing through duct 17 to the chamber. The sensor may, for example, be a scattered light sensor or, as shown, a light obscuration sensor comprising an emitter 25 mounted in chamber 16 and arranged to emit a beam of light along duct 17 towards a retro-reflective surface 26 located in the cup or housing 14. Light reflected from surface 26 is received by a receiver 27 located adjacent emitter 25 in chamber 16. The sensor is connected to the control unit 2 for use in controlling operation of the apparatus as will be described.

Preferably the light obscuration sensor has a high resolution and may be self-monitoring and self-calibrating to accommodate any build up of contamination on the optical surfaces. The emitter 25 preferably emits infra-red light with a predominant wavelength near 880 nm so that the output corresponds directly with the methods of sensitivity measurement specified for optical smoke detectors in EN54:part7. Tests have shown that, if the properties of the aerosol are well specified, and it is generated in a carefully controlled manner, there is a close relationship between the light obscuration and the light scattered at shallow forward angles, the technique which is used in most optical smoke detectors. For ionisation smoke detectors, a good correlation may also be achieved.

Aerosol is supplied to the chamber 16 through a small aperture 19 from an aerosol reservoir 18 defined by a housing 29 in which the chamber 16 may, as shown, be mounted. Conveniently, the aerosol is an atomised liquid produced from a pressurised container 24 of liquid, the container having a valved outlet 24*a* with atomising means. The valve of the container of aerosol may, as shown, be operated by an electromagnetic operating means 23, e.g. comprising a solenoid, which is connected for control to the control unit.

The minimum amount of aerosol that can be produced from the shortest practicable operating time, of about 20 ms, of the valve of the container, is much greater than that required to exceed a typical optical smoke detector alarm threshold. Thus it is necessary to, in effect, smooth the pulse or pulses of aerosol provided by operation of the valve of container 24 to provide a supply of lower concentration aerosol which is continuously available to the sensing loop. This is achieved by discharging the aerosol from the container into the air in the aerosol reservoir 18. The aerosol is then supplied as required to the chamber 16 and the sensing loop through opening 19.

Supply of the aerosol to the chamber 16 via aperture 19 is obtained by providing the reservoir with means for varying the pressure in the reservoir relative to that in chamber 16. As shown in FIG. 2, the reservoir has an air inlet provided with an axial fan 21 which is a variable speed fan and is connected for control to the control unit.

The capacity of the fan 20 and the design and volume of the sensing loop are arranged so that the air speed over the smoke detector 12 under test is maintained approximately constant at about 0.2 m/s, the optimum speed for which smoke detectors are specified to operate. The fan 21 is more powerful than the fan 20 and can be driven at a speed such as to maintain a higher pressure in the aerosol reservoir 18 than in chamber 16 to cause air to flow from reservoir 18 into chamber 16.

To enable the user to perform a test while standing on the ground, the control unit 2 is electrically connected to the assembly 1 by a cable 3 carrying at its end a hand grip 4. The hand grip 4 is connectable electrically and mechanically to the assembly 1 either directly or indirectly using one or more extension poles 5 which can be connected between the hand grip 4 and the assembly 1. The control unit 2 may be carried by the operator, for example on a shoulder harness.

The length of the assembly 1 and hand grip 4 may be such that smoke detectors on ceilings of up to about 3 meters high may conveniently be tested. Extension poles 5 may then be used so that smoke detectors mounted on high ceilings, for example up to about 10 meters in height, may be tested.

In use of the apparatus shown in FIGS. 1 and 2, the following control conditions are available:

1. With the fan 20 on and fan 21 off, the pressure in the chamber 16 is substantially higher than in the aerosol reservoir 18. No aerosol is supplied to the sensing loop and the fan 20 operates to rapidly empty the sensing loop of aerosol.

2. With the fan 20 on and the fan 21 on at low speed, the pressure in the chamber 16 is slightly higher than in the aerosol reservoir 18 so that the concentration of aerosol in the sensing loop will slowly reduce.

3. With the fan 20 on and the fan 21 on at medium speed, the pressure in the aerosol reservoir 18 is slightly higher than in the chamber 16 so that aerosol will be supplied slowly to the sensing loop, which may result in a slowly increasing concentration of aerosol in the sensing loop.

4. With the fan 20 on and the fan 21 on at high speed, the pressure in the aerosol reservoir 18 is substantially higher than in the chamber 16. The flow of aerosol into the sensing loop is increased so that the concentration of aerosol in the sensing loop increases more rapidly.

When the fan 21 is driven at speeds above a predetermined threshold, to maintain the required concentration of aerosol in the aerosol reservoir and therefore to maintain the required concentration of aerosol in the air supplied from the reservoir to the sensing loop, aerosol is generated intermittently in the aerosol reservoir by operation of the valve operating means 23.

As previously mentioned, upstream of fan 20, duct 15 may be provided with an air bleed inlet 22. This reduces the likelihood that air will be drawn into the sensing loop around the open top of the cup 14, which would tend to reduce the concentration of aerosol around the smoke detector 12 relative to that measured in the duct 17. However, inlet of air into the sensing loop has the effect of reducing the concentration of aerosol in the loop. As a result, in order to maintain a constant aerosol concentration in the sensing loop, it may be necessary to operate the fans 20, 21 as set out at 3 above.

The control unit 2 comprises a microcomputer 7 to which the output of the sensor is supplied and for controlling the fans 20, 21 and valve operating means 23 in dependence on the output of the sensor, to provide the required and predetermined levels and changes in level of aerosol concentration in the sensing loop. The microcomputer may be preprogrammed to provide a variety of different options and levels which can be preselected using an input keyboard 9, the control unit communicating with the user by a display 8. The control unit also includes a rechargeable battery pack 10 and an on-off switch 30. Once switched on, the apparatus can be activated from the control unit and/or by operation of switch means 11, e.g. a non-latching push switch, conveniently mounted on the hand grip 4.

To use the above described apparatus to test an installed smoke detector 12, for example as shown mounted on ceiling 13, the user arranges the cup or housing 14 of the assembly 1 so as to shroud the smoke detector 12.

By way of example only, one test cycle, to determine the concentration of aerosol at which the smoke detector is activated, may comprise progressively increasing the concentration of aerosol from a low level below that at which the smoke detector should operate and noting the concentration at which the detector is operated. Alternatively, to check that the sensitivity of the smoke detector is between pre-determined limits, a first predetermined level of concentration of aerosol is established within the sensing loop, the level being just below that at which the smoke detector should be activated. If the detector is activated at this level, it is too sensitive. If the detector is not activated, the concentration of aerosol in the sensing loop is rapidly increased to a second predetermined level which is just above the level at which the detector should have been activated. If the detector has not been activated at this level, it is too insensitive or defective.

In operation, the control unit is switched on and the apparatus to be put into a condition ready for use, before the head assembly is located over a smoke detector to be tested. The control unit causes the fan 20 to be switched on, the fan 21 remaining switched off, to establish a flow of clean air through the sensing loop which is sensed by the sensor. The control unit then zeros the sensor and, through the display 8, indicates that the apparatus is ready for a test. The user then places the cup 14 in position over a smoke detector and operates the switch 11 to start the test, which has been preselected by the user using keyboard 9. The control unit then switches the fans 20, 21 on and off, varies the speed of fan 21 and operates the valve operating means 23 to supply aerosol to the aerosol reservoir to provide the required concentrations of aerosol in the sensing loop.

If the test cycle is to determine the concentration of aerosol at which the smoke detector is activated, the moment of illumination of the lamp is noted by the user and the switch 11 operated to terminate the test, the display then indicating the concentration of aerosol at which the smoke detector was activated. If the test cycle is to check that the sensitivity of the smoke detector is between predetermined limits, the cycle proceeds automatically and the user notes at which point in the cycle, if at all, the smoke detector is activated. This point may be recorded by operation of switch 11 and this operation of the switch may terminate the cycle. It will be appreciated that the apparatus may be used in similar ways with a detector which indicates activation other than by illumination of a lamp, e.g. by an audible or other visible signal.

At the end of the test, the fan 21 may be switched off leaving the fan 20 running to clear aerosol out of the smoke detector 12, before the cup or housing 14 is removed from its position around the smoke detector. The fan 20 may remain on for a further period of time after the apparatus has been withdrawn from the smoke detector to clear aerosol out of the sensing loop.

Figure 3:
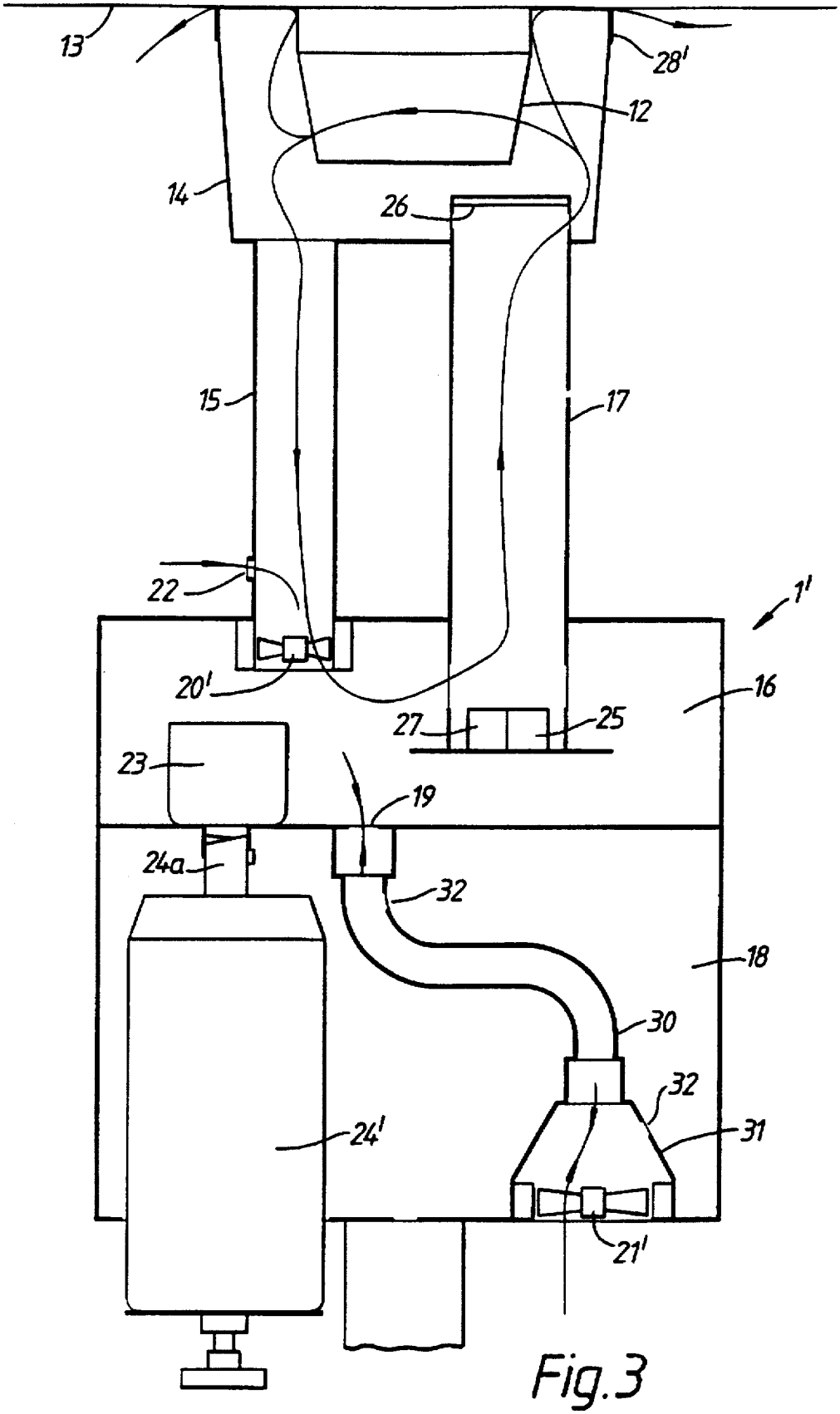
FIG. 3 is a diagrammatic sectional view of a further embodiment of part of the apparatus according to the present invention.
Figure 4:
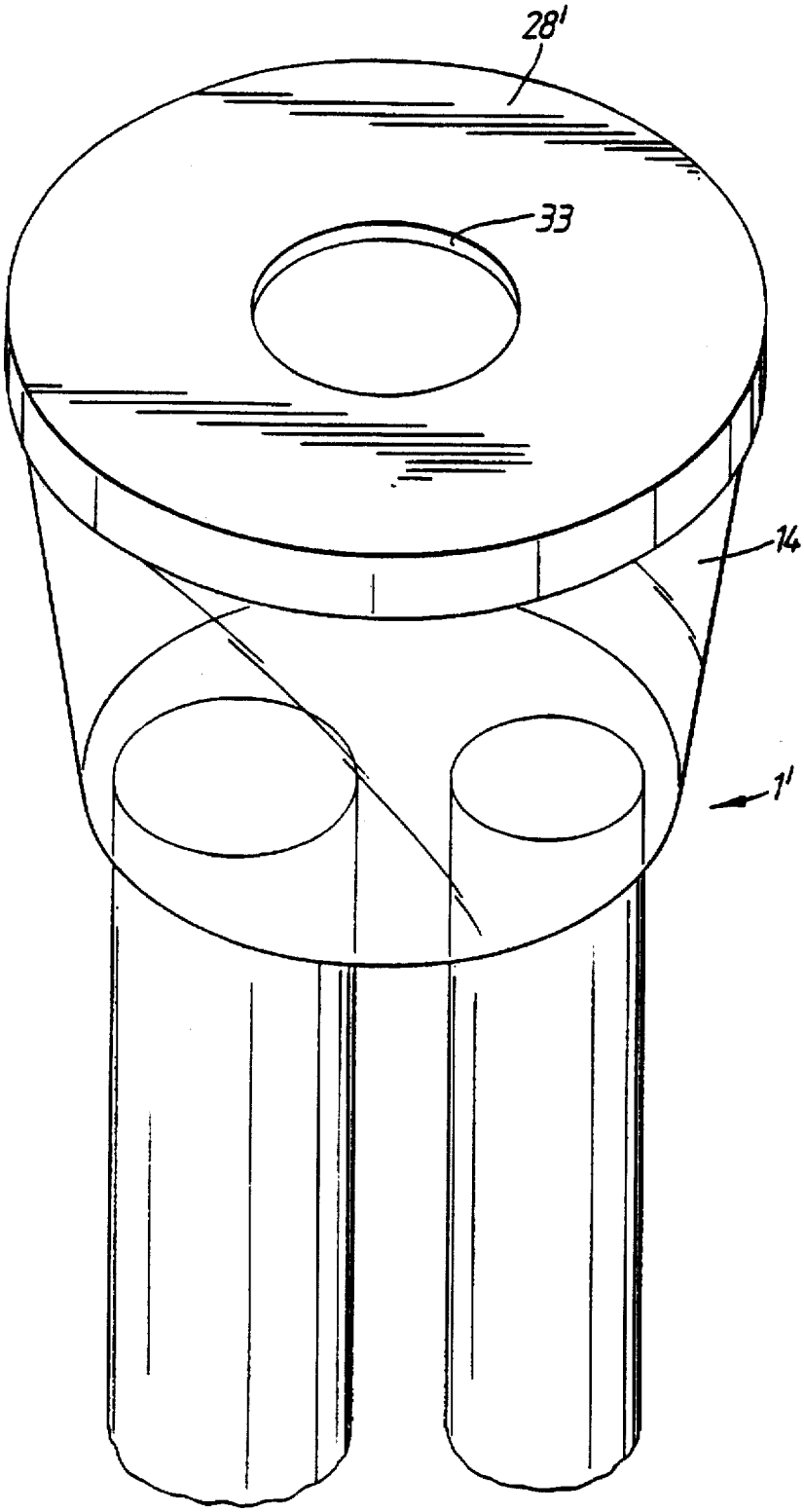
FIG. 4 is a top perspective view of part of the apparatus of FIG. 3.

An alternative embodiment of the head assembly of the present invention is shown in FIGS. 3 and 4. The head assembly 1' of FIGS. 3 and 4 is substantially similar to that shown in FIG. 2 and like reference numerals will be used for like parts. The main difference between the embodiment of FIGS. 3 and 4 and that of FIG. 2 is that the fan 21 has been replaced by an axial fan 21' in the base of the aerosol reservoir 18 and that fan 21' is connected with aperture 19 via a duct 30. The fan 21' is a variable speed fan connected for control to the control unit 2 (as shown in FIG. 1).

A tapered funnel 31 is fitted over the interior of the fan 21', the funnel being connected to one end of the duct 30, the other end of the duct 30 being connected to the aperture 19. The funnel may be made of plastics material and the duct may comprise a flexible corrugated plastics hose, but any other suitable material may be used. A number of small holes or apertures 32 are formed in walls of the duct and/or funnel.

Air is sucked into the funnel 31 and duct 30 by fan 21' and is then mixed with the aerosol which enters the duct and/or funnel via the holes 32. The mixture of air and aerosol then passes through aperture 19 into the chamber 16 to be circulated through the sensing loop in the same way as is described above with reference to FIG. 2. The arrangement shown in FIG. 3 enables the interchange of air pressures between the chamber 16 and the aerosol reservoir 18 to be controlled more accurately than in the embodiment of FIG. 2.

In FIG. 3 the seal 28' on the rim of the cup or housing 14 is a clear or translucent membrane seal which, as can be more clearly seen in FIG. 4, has an opening 33 for surrounding the smoke detector 12. Such a membrane seal provides an improved seal against the ceiling and the translucency ensures any indicating lamp on the detector 12 is visible during the test.

Additionally, in FIG. 3, the aerosol container 24' is fitted through the base of the reservoir 18 for ease of removal and replacement.

Finally, the axial fan for circulating air in the sensing loop may be a variable speed fan 20' controlled by the control unit 2. The use of a variable speed fan 20' permits the creation of different air flow rates such as may be required by the tester for optical and ionisation detectors.

The above described apparatus can be robustly constructed of suitable metal and plastics materials. Suitable axial DC fans and solenoid operated devices are readily available. A suitable aerosol is supplied under reference FPAO4 by No Climb Products Limited. An example of a suitable microprocessor is MC68HC705B16 supplied by Motorola Inc. The obscuration sensor may comprise LEDs, specifically infra-red LEDs, and photodiodes. For example, it may be a battery powered version of an obscuration meter which meets the requirements of BS5445:part7 available from A.W. Technology Limited. While as described above, the sensor operates with infra-red light, the apparatus may also be used to check domestic smoke detectors, for which the UK standard is BS5446:part1:1990, the obscuration sensor then operating with visible light and preferably green light.

While as described above the aerosol is a liquid aerosol generated intermittently, it will be appreciated that the aerosol may take other forms, e.g. may be solid, and may be generated continuously in the aerosol reservoir.

There is thus provided a smoke detector testing apparatus for quantitative or qualitative in-situ sensitivity testing which is capable of measuring the sensitivity of the majority of point smoke detectors in common use to a level of accuracy significantly better than the typical alarm threshold sensitivity of a smoke detector. It is fully field portable without needing to be connected to a mains electricity supply, is rugged and is simple to use with a relatively short test time for each detector. It is efficient in its use of aerosol and requires minimum user maintenance.

We claim:

1. Apparatus for testing the sensitivity of a smoke detector in-situ, comprising a head assembly comprising, a housing for surrounding a smoke detector in-situ and forming part of, means defining a circulating loop through which air carrying an aerosol will, in operation, circulate, said means including a defined delivery flow path and a defined return flow path, sensor means for directly sensing the concentration of aerosol in the air circulating in the loop, air circulating means for causing air to circulate in the loop, aerosol supply means for supplying aerosol to the loop and control means for controlling the concentration of aerosol in the air circulating in the loop by controlling the air circulating means and the aerosol supply means in dependence on the output of the sensing means.

2. Apparatus according to claim 1, wherein the housing is generally cup shaped with an opening in the top for surrounding the smoke detector.

3. Apparatus according to claim 2, wherein the opening in the top of the housing is provided with a seal for sealing around the smoke detector, such that said housing sealingly encloses said detector.

4. Apparatus according to claim 1, wherein the means defining the loop for circulating air comprises a chamber communicating with the housing by a first duct for flow of air to the housing and a second duct for flow of air from the housing.

5. Apparatus according to claim 4, wherein the sensor means is arranged to sense the concentration of aerosol in the first duct.

6. Apparatus according to claim 4, wherein the air circulating means is arranged in the second duct.

7. Apparatus according to claim 6, wherein an air bleed inlet is provided in the second duct up-stream of the air circulating means.

8. Apparatus according to claim 1, wherein the air circulating means is a fan operated to create a super-atmospheric pressure in the chamber.

9. Apparatus according to claim 1, wherein the aerosol supply means comprises an aerosol reservoir in communication with the chamber, means for generating aerosol in the reservoir and means for controlling the flow of aerosol from the reservoir to the chamber.

10. Apparatus according to claim 9, wherein the means for controlling the flow of aerosol from the reservoir to the chamber comprises means for varying the pressure in the reservoir relative to the pressure in the chamber under the control of the control means.

11. Apparatus according to claim 9, wherein the aerosol generating means comprises a container of liquid having a valved outlet with atomising means and valve operating means controlled by the control means for intermittently generating aerosol in the aerosol reservoir.

12. Apparatus according to claim 9, wherein the aerosol generating means generates aerosol continuously, the aerosol reservoir providing a mixing or dispersing chamber from which aerosol at a lower concentration is available for supply to the head assembly.

13. A method of using the apparatus of claim 1, wherein the apparatus is operated by the control means to establish a first lower concentration of aerosol in the air circulating in the housing and to then increase the concentration to a second higher level, the first level being below that at which the smoke detector should be activated and the second being above that at which it should be activated.

14. A method of using the apparatus according to claim 13 to determine the concentration of aerosol at which a smoke detector is activated or to check that the sensitivity of the smoke detector is between predetermined limits.

* * * * *